United States Patent [19]

Gardiner

[11] Patent Number: 4,846,351

[45] Date of Patent: Jul. 11, 1989

[54] KNITTING AND CROCHET NEEDLE KIT

[76] Inventor: Loretta L. Gardiner, 2565 S. Mayflower, Arcadia, Calif. 91006

[21] Appl. No.: 213,775

[22] Filed: Jun. 30, 1988

[51] Int. Cl.[4] ..... B65D 71/00

[52] U.S. Cl. ..... 206/574; 206/459; 66/1 A; 66/118

[58] Field of Search ..... 206/380, 459, 574; 66/116, 117, 118, 1 A; 223/102

[56] References Cited

U.S. PATENT DOCUMENTS

| | | | |
|---|---|---|---|
| 677,832 | 6/1901 | Wickham . | |
| 1,477,427 | 2/1921 | Christensen . | |
| 2,024,794 | 12/1935 | Carlson | 66/118 |
| 2,093,631 | 6/1936 | Burnham . | |
| 2,246,254 | 6/1941 | Johnston | 66/118 |
| 2,353,875 | 4/1943 | Burnham . | |
| 3,225,914 | 12/1965 | Klein et al. | 206/459 |
| 3,384,220 | 5/1968 | Linstead | 206/574 |
| 3,927,538 | 12/1975 | Martella . | |
| 4,047,397 | 9/1977 | Laliberte | 66/1 A |
| 4,155,446 | 5/1979 | Aronson | 206/459 |
| 4,478,333 | 10/1984 | Dalbo et al. | 206/574 |
| 4,494,387 | 1/1985 | Phipps . | |

*Primary Examiner*—David T. Fidei
*Attorney, Agent, or Firm*—William W. Haefliger

[57] ABSTRACT

A knitting apparatus kit comprises (a) at least two elongated knitting needle shafts, each shaft having a cap at one end and a primary connector at its opposite end, (b) two primary short shafts each having a secondary connector at one end thereof selectively and alternately endwise connectible to the primary connector of one of the elongated shafts, one short shaft having an endwise tapered opposite end and the other short shaft having a crochet hook shaped opposite end, (c) and two secondary short shafts, each having a secondary connector at one end thereof, selectively and alternately endwise connectible to the primary connector of the other of the elongated shafts, one secondary short shaft having an endwise tapered opposite end and the other secondary short shaft having a modified crochet hook shaped opposite end, (d) there being a container, and all of the shafts being carried by the container for selective use of one or the other of the elongated shafts and one primary or secondary short shaft associated therewith.

10 Claims, 1 Drawing Sheet

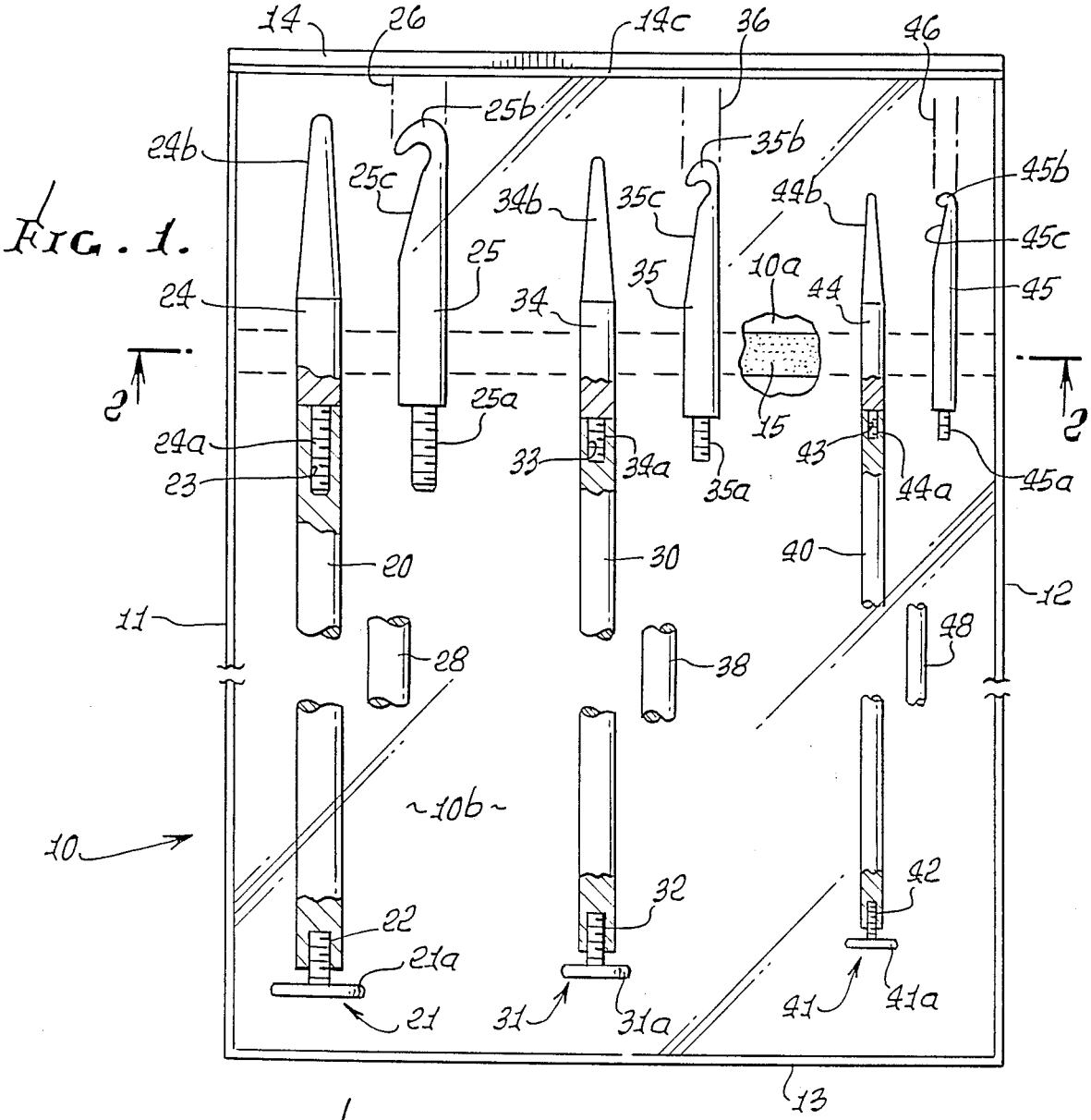
FIG. 1.
FIG. 2.
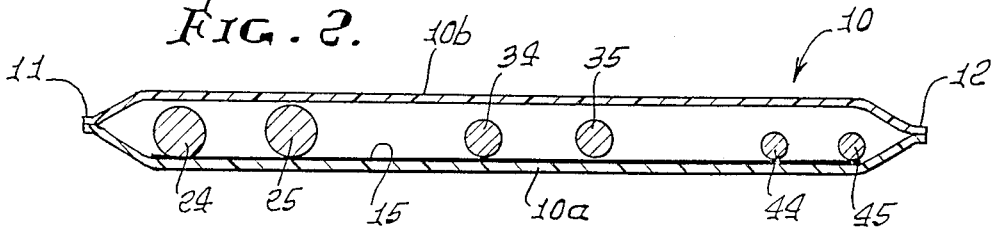
FIG. 3.
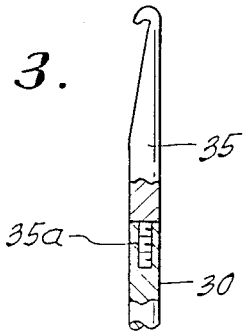
FIG. 4.
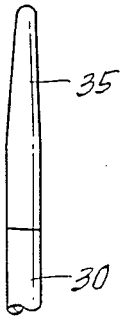

KNITTING AND CROCHET NEEDLE KIT

BACKGROUND OF THE INVENTION

This invention relates generally to knitting equipment, and more particularly to sets of shafts enabling selective knitting and crochet-pull techniques, all employing elongated main shafts used in knitting.

Typical known knitting operations include: knitting, purling, "yarn over" when knitting, "yarn over" when purling, pick up and knit stitches on edges (involving use of a crochet hook), slip of a stitch, change of yarn, color, ravel of stitches, and picking up dropped stitches (including use of a crochet hook).

There is need for means enabling ease of access to and use of a crochet hook of a size adapted to the size of a knitting needle, as during knitting; and there is need for different sizes of knitting needles and corresponding crochet hooks, all without requiring a very large number of components.

SUMMARY OF THE INVENTION

It is a major object of the invention to meet the above need through provision of a knitting apparatus kit. The kit typically includes:

(a) at least two elongated knitting needle shafts, each shaft having a cap at one end and a primary connector at its opposite end, (b) two primary short shafts each having a secondary connector at one end thereof selectively and alternately endwise connectible to the primary connector of one of the elongated shafts, one short shaft having an endwise tapered opposite end and the other short shaft having a crochet hook shaped opposite end, (c) and two secondary short shafts, each having a secondary connector at one end thereof, selectively and alternately endwise connectible to the primary connector of the other of the elongated shafts, one secondary short shaft having an endwise tapered opposite end and the other secondary short shaft having a crochet hook shaped opposite end, (d) there being a container means, and all of the shafts being carried by the container means for selective use of one or the other of the elongated shafts and one primary or secondary short shaft associated therewith.

It is a further object to provide the hooks to have modified crochet hook shape; thus, the hook is preferably entirely within a cylindrical extension of the other short shaft; it is everywhere outwardly convex, beyond a tapered side intersecting the hook interior, and its back side is tapered so as to be usable as a knitting needle tip.

It is another object to provide the elongated shafts to be cylindrical and to have different diameters, the two primary short shafts each locally having substantially the same diameter as the one elongated shaft, and the two secondary short shafts each locally having substantially the same diameter as the other elongated shaft.

Another object is to provide a kit wherein interconnectible primary and secondary connectors are threaded; and wherein threaded interconnectible primary and secondary connectors include an externally threaded shank on the elongated shaft and an internally threaded bore on a short shaft.

A further object is to provide a first indicator on one elongated shaft and on each primary short shaft, and a second indicator on the other elongated shaft and on each secondary short shaft, thereby enabling ease of selection of associated long and short shafts from the kit. The first indicator may be characterized by a first color, and the second indicator characterized by a second color, whereby the needles and attachments are color coded. The kit preferably contains three sets of needles and attachments as will appear.

These and other objects and advantages of the invention, as well as the details of an illustrative embodiment, will be more fully understood from the following specification and drawings, in which:

DRAWING DESCRIPTION

FIG. 1 is an elevation showing a kit that includes needle sets with knitting and crochet tip attachments;

FIG. 2 is a section taken on lines 2—2 of FIG. 1;

FIG. 3 is a fragmentary view showing a crochet tip attached to a needle shaft; and FIG. 4 shows the back side of a crochet type hook.

DETAILED DESCRIPTION

The kit of FIG. 1 includes knitting apparatus within a container 10, as for example a transparent, flexible plastic package having closed opposite edges 11 and 12, and end 13. End 14 of the container is manually openable to gain access to selected apparatus within the kit. A lateral adhesive band 15 on the inner side of the container lower sheet 10*a* may for example be employed to releasably position and releasably retain the shafts of the apparatus within the container, as seen in FIGS. 1 and 2. A manually openable and closable seal band 14*c* is employed at end 14 of the container. Container upper sheet 10*b* is sealed to the lower sheet 10*a* at edges 11, 12 and 13. Other equivalent containers are usable.

The kit includes sets of shafts as seen in FIGS. 1 and 2, and typically two or more (and preferably three) sets are employed. See for example the two elongated knitting needle shafts 20 and 30, and the third needle shaft 40. Each such shaft has a cap at one end, as represented by the caps 21, 31 and 41, with enlarged flanges 21*a*, 31*a* and 41*a*. The caps may have threaded attachment to the needle shafts as at 22, 32, and 42. Also, each shaft has a primary connector at its opposite end. See the primary connectors in the form of threaded bores 23, 33, and 43, the latter extending longitudinally as to the needle shafts.

One set of shafts includes for example the two primary short shafts 24 and 25, each having a secondary connector at one end thereof, selectively and alternately endwise connectible to the primary connector 23 of shaft 20. Thus, shaft 24 is shown as connected by threaded connector shank 24*a* to threaded bore 23, and shaft 25 is alternately connected by threaded shank 25*a* to bore 23, when the needle is to be used for easier pulling of a yarn section through fabric, as in knitting. One short shaft, i.e. shaft 24, has an endwise tapered opposite end 24*b*, as used in knitting; and the other short shaft, i.e. shaft 25, has a modified crochet hook shaped opposite end 25*b*, for use in such pulling of the yarn section through fabric. Hook-shaped end 25*b* is J-shaped, and has a taper 25*c* on the side of the shaft 25. Note that the entirety of hooked end 25*b* is within a cylinder 26 defined by the cylindrical surface of shaft 25, the latter having the same diameter as shaft 20, so that the user's fingers will slide easily along the entire lengths of 20 and 25. The hook is also everywhere outwardly convex, above taper 25*c*. Such parts may be of lightweight metal, such as aluminum. Also, the back side of the hook is tapered upwardly (see FIG. 4) to be usable as a knitting needle.

The same features and elements are also found associated with needle shafts 30 and 40, and correspond as follows:

| | 20 | | 30 | | 40 |
|---|---|---|---|---|---|
| primary short shafts | 24 | secondary short shafts | 34 | tertiary short shafts | 44 |
| | 25 | | 35 | | 45 |
| | $24^a$ | | $34^a$ | | $44^a$ |
| | $25^a$ | | $35^a$ | | $45^a$ |
| | $24^b$ | | $34^b$ | | $44^b$ |
| | $25^b$ | | $35^b$ | | $45^b$ |
| | $25^c$ | | $35^c$ | | $45^c$ |
| | 26 | | 36 | | 46 |

The diameters of short shafts 24 and 25, which are equal to the diameter of shaft 20, are greater than the diameters of short shafts 34 and 35 (which are equal to the diameter of shaft 30); and these in turn are greater than the diameters of short shafts 44 and 45 (which are equal to the diameter of shaft 40). Thus, the user can easily select a knitting needle size required for the knitting task at hand, and the corresponding short shafts (24 and 25; 34 and 35; and 44 and 45 as the case may be) will be at hand, as required.

Indicators are preferably associated with, i.e. on, the shafts of the sets, as for example as follows:

| | |
|---|---|
| Shaft set 20, 24 and 25 | Color I |
| Shaft set 30, 34 and 35 | Color II |
| Shaft set 40, 44 and 45 | Color III |

In this regard, color indicators, or other indicators are usable. The different diameters of the shafts of the sets may be regarded as indicators, although different colors are preferable.

FIG. 3 shows how a hook bearing short shaft (such as 35) is directly and easily connectible to a long shaft (such as 30) as an alternate to a tapered ended short shaft 34.

The kit also typically includes a second knitting needle in each set, like the units 20 and 24, 30 and 34, and 40 and 44, to be held by the user's other hand. See indicated second needles 28, 38, and 48, in FIG. 1.

I claim:

1. A knitting apparatus kit comprising (a) at least two elongated knitting needle shafts, each shaft having a cap at one end and a primary threaded connector at its opposite end, (b) two primary short shafts each having a secondary threaded connector at one end thereof selectively and alternately endwise threadably connectible to the primary threaded connector of one of the elongated shafts, one short shaft having an endwise tapered opposite end and the other short shaft having a crochet hook shaped opposite end, (c) and two secondary short shafts, each having a secondary threaded connector at one end thereof, selectively and alternatively endwise connectible to the primary threaded connector of the other of the elongated shafts, one secondary short shaft having an endwise tapered opposite end and the other secondary short shaft having a crochet hook shaped opposite end, (d) there being a container means, and all of said shafts being carried by the container means for selective use of one or the other of the elongated shafts and one primary or secondary short shaft associated therewith, (e) said two elongated shafts being cylindrical and having different diameters, the two primary short shafts each locally having substantially the same diameter as said one elongated shaft to provide smooth outer cylindrical surface transition between said primary short shafts and said one elongated shaft and the two secondary short shafts each locally having substantially the same diameter as said other elongated shaft to provide smooth cylindrical surface transition between said secondary short shafts and said other elongated shaft, (f) a selected one of the primary short shafts being connected to said one elongated shaft by intercoupling of said primary connectors thereof, and a selected one of the secondary short shafts being connected to said other elongated shaft by intercoupling of said secondary connectors thereof.

2. The kit of claim 1 wherein threaded interconnectible primary and secondary connectors include an externally threaded shank on the elongated shaft and an internally threaded bore on a short shaft.

3. The kit of claim 1 wherein each hook shaped opposite end on a short shaft lies within a cylinder defined by the surface of the short shaft.

4. The kit of claim 1 including a first indicator on one elongated shaft and on each primary short shaft, and a second indicator on the other elongated shaft and on each secondary short shaft.

5. The kit of claim 4 wherein said first indicator is characterized by a first color, and said second indicator is characterized by a second color.

6. The kit of claim 1 wherein at least a part of the secondary short shaft is connected to said other elongated shaft by intercoupling of said primary and secondary connectors thereof.

7. The kit of claim 1 including means associated with the kit to position the shafts in the container.

8. The kit of claim 4 wherein the hook is everywhere outwardly convex beyond an elongated tapered flat, intersecting the inner side of the hook.

9. The kit of claim 1 including (e) a third elongated knitting needle shaft, the shaft having a cap at one end and a primary connector at its opposite end, (f) two tertiary short shafts each having a secondary connector at one end thereof selectively and alternately endwise connectible to the primary connector of the third elongated shafts, one short shaft having an endwise tapered opposite end and the other short shaft having a crochet hook shaped opposite end, (g) and two tertiary short shafts, each having a secondary connector at one end thereof, selectively and alternately endwise connectible to the primary connector of the third elongated shaft, one tertiary short shaft having an endwise tapered opposite end and the other tertiary short shaft having a crochet hook shaped opposite end, (h) the third elongated shaft and the two tertiary short shafts also positioned in the container means.

10. The kit of claim 1 wherein the back side of each other short shaft having crochet hook shape is flatly tapered toward the end of that short shaft which is convex.

* * * * *